United States Patent [19]

Abendroth et al.

[11] 4,295,421

[45] Oct. 20, 1981

[54] SAFETY DEVICE FOR GUARDING NIPS IN A SHEET-FED ROTARY PRINTING PRESS

[75] Inventors: Paul Abendroth, Offenbach am Main; Dietrich Dettinger, Dietzenbach, both of Fed. Rep. of Germany

[73] Assignee: M.A.N.-Roland Druckmaschinen Aktiengesellschaft, Fed. Rep. of Germany

[21] Appl. No.: 137,915

[22] Filed: Apr. 7, 1980

[30] Foreign Application Priority Data

Apr. 7, 1979 [DE] Fed. Rep. of Germany ..... 2914152

[51] Int. Cl.[3] ..... B41F 5/00

[52] U.S. Cl. ..... 101/216; 100/53; 74/613; 192/130; 200/50 C

[58] Field of Search ..... 101/216; 100/53; 192/129 R, 129 A, 130, 131 R, 131 H, 133; 400/54; 200/50 R, 50 C; 74/609, 613

[56] References Cited

U.S. PATENT DOCUMENTS

| | | | |
|---|---|---|---|
| 2,366,930 | 1/1945 | Pirie | 101/216 X |
| 3,498,217 | 3/1970 | Kletti | 101/216 |
| 3,730,296 | 5/1973 | Huigens | 100/53 X |
| 3,749,005 | 7/1973 | Elnecuer et al. | 100/53 |
| 4,113,079 | 9/1978 | Wright | 100/53 X |

*Primary Examiner*—E. H. Eickholt

*Attorney, Agent, or Firm*—Leydig, Voit, Osann, Mayer & Holt, Ltd.

[57] ABSTRACT

A sheet-fed rotary printing press having lower and upper blanket cylinders in running engagement with an impression cylinder to form nips accessible through an access space. The driving means for the cylinders includes an inching circuit and a drive enabling circuit. An interlock switch adjacent the access space is connected in the drive enabling circuit. A safety subassembly and a washing subassembly are provided with quickly disengageable means for mounting the subassemblies in position successively in the access space. The safety subassembly includes a guard plate having a normal position in which the plate closes off the access space and forms a sheet guide. A first disengageable linkage couples the guard plate to the interlock switch so that when the plate is in its normal position the enabling circuit is enabled for normal driving of the press and so that when the guard plate is absent from its normal position the press is limited to inching movement. A second disengageable linkage couples the washing subassembly to the interlock switch so that when the washing subassembly is in the access space in place of the safety subassembly the enabling circuit is enabled to permit normal driving of the press for washing purposes. In the preferred embodiment the guard plate is formed of two sections horizontally hinged together.

14 Claims, 8 Drawing Figures

SAFETY DEVICE FOR GUARDING NIPS IN A SHEET-FED ROTARY PRINTING PRESS

It is conventional to install guards at the accessible nips of a rotary printing press coupled to interlock switches so that if the guard is disturbed the printing press is automatically shut down. Typical safety devices of this type are shown in German Pat. No. 766,210, German Auslegeschrift No. 1,165,044, East German Pat. No. 24,753 and French Pat. Nos. 833,280 and 1,579,086.

However, the prior arrangements are disadvantageous for a number of reasons including the fact that the guards are permanently installed which prevents interchangeability with an auxiliary unit such as washing equipment.

It is, accordingly, an object of the present invention to provide a safety subassembly including a guard which protects the nips between adjacent cylinders of a printing press and which may be easily and quickly removed for substitution of an auxiliary unit such as a washing subassembly in the guarded position. The subassemblies are coupled to an interlock switch in a drive enabling circuit so that when either of the subassemblies is in operating position the nip is protected and the drive enabling circuit produces normal driving of the press. However, when the guard plate is not in operating position, or when either of the subassemblies is removed, the enabling circuit is disabled so that operation of the press is limited to inching movement for safety's sake. It is another object of the present invention to provide a safety subassembly including a guard plate which is swingable between a closed, protecting position in which the press may operate normally and an upraised position providing access for manual cleaning in which the drive circuit of the press is disabled to limit the press operation to inching movement in a safe direction. It is a more specific object of the present invention to provide a safety subassembly for guarding adjacent nips in a rotary press and which includes a guard plate having lower and upper sections hinged together about a horizontal axis, with the lower section being swingable between closed and open positions with interengaging stops between the sections so that the lower section serves to position the upper section to provide optimum sheet guidance in addition to performing a safety function.

It is a general object of the present invention to provide a safety device which is economical and highly efficient, providing optimum protection under running conditions while nevertheless enabling access to the nip for purposes of cleaning or inspection under safe "inching" conditions. It is yet another object of the invention to provide a safety device which is highly versatile and which permits prompt substitution of an auxiliary subassembly to occupy the guarded space and which may, for example, be in the form of a washing device.

The objects and advantages of the invention will become apparent upon reading the attached detailed description and upon reference to the drawings in which:

FIG. 1 shows a safety subassembly as installed in a rotary press as viewed, in elevation, along the line 1—1 in FIG. 2.

FIG. 1*a* is a rudimentary control diagram showing an inching circuit, drive enabling circuit and interlock switch for the latter.

FIG. 1*b* is a fragmentary elevation looking along line 1*b*—1*b* in FIG. 2 and showing the nature of the linkage between the guard plate and the switch in its "enabling" condition.

While the invention has been described in connection with the preferred embodiment, it will be understood that we do not intend to be limited by the embodiment shown but intend, on the contrary, to cover the various alternative and equivalent constructions included within the spirit and scope of the appended claims.

Figure 1A:
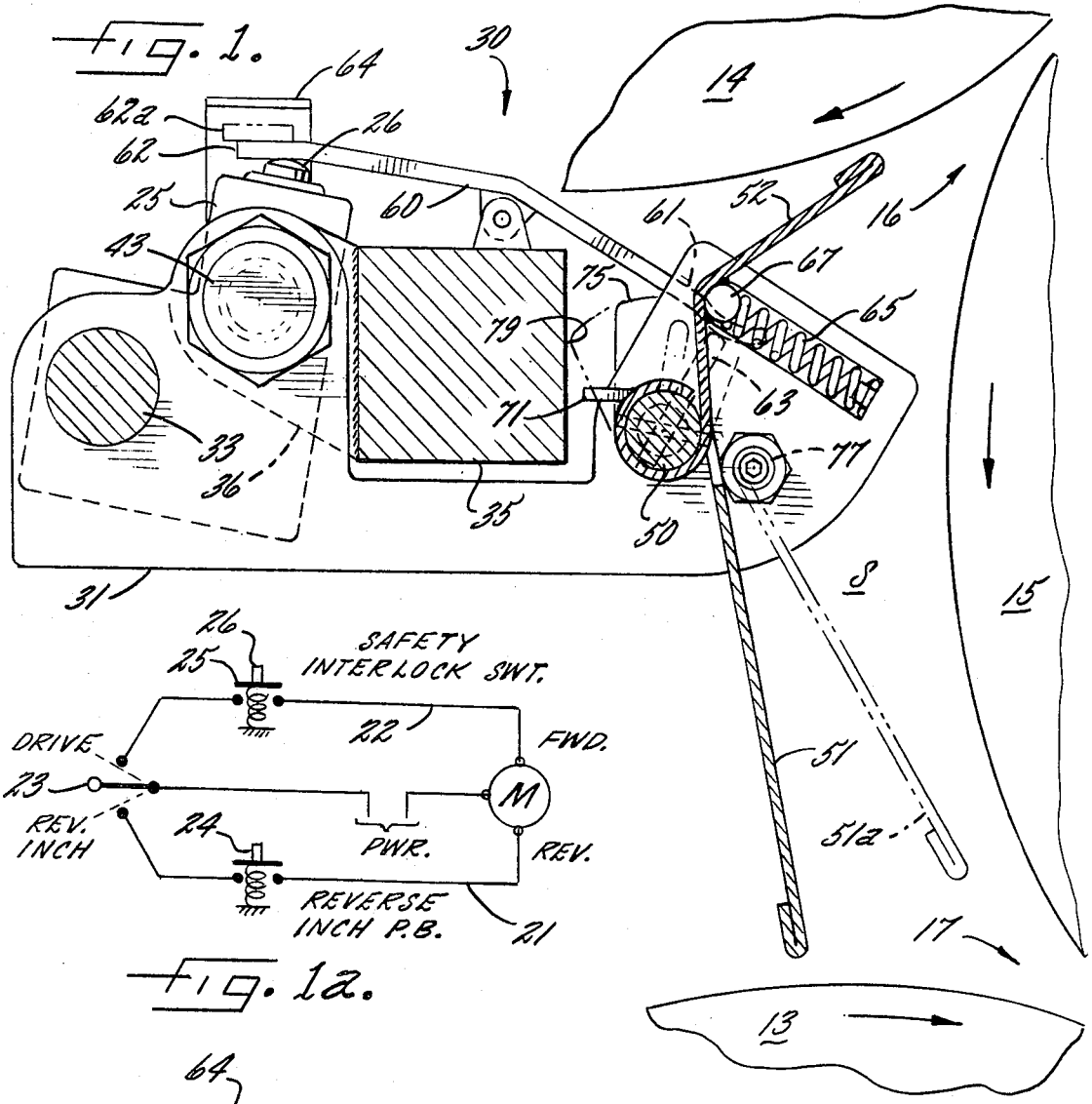
Figure 1B:
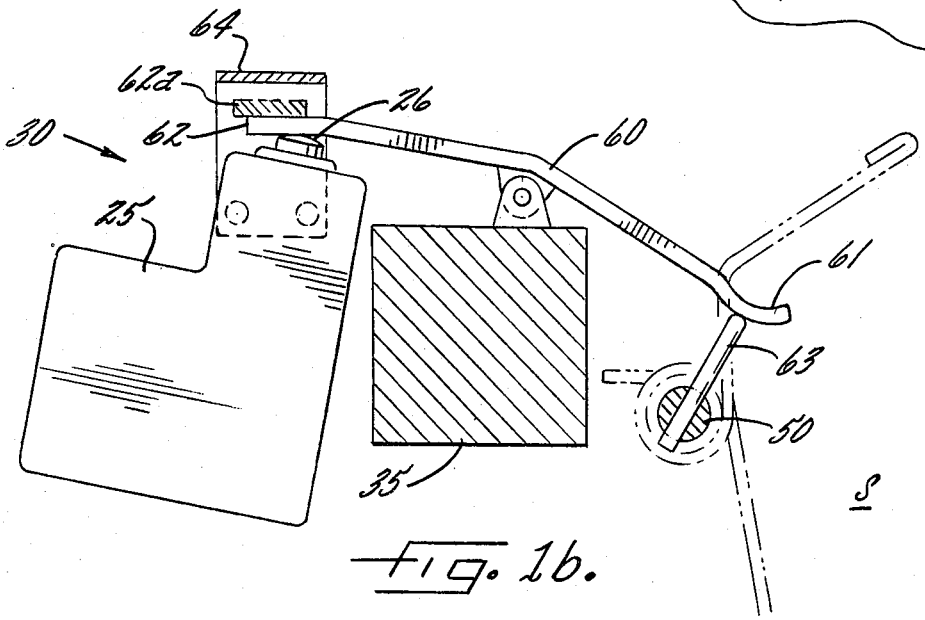
Figure 2:
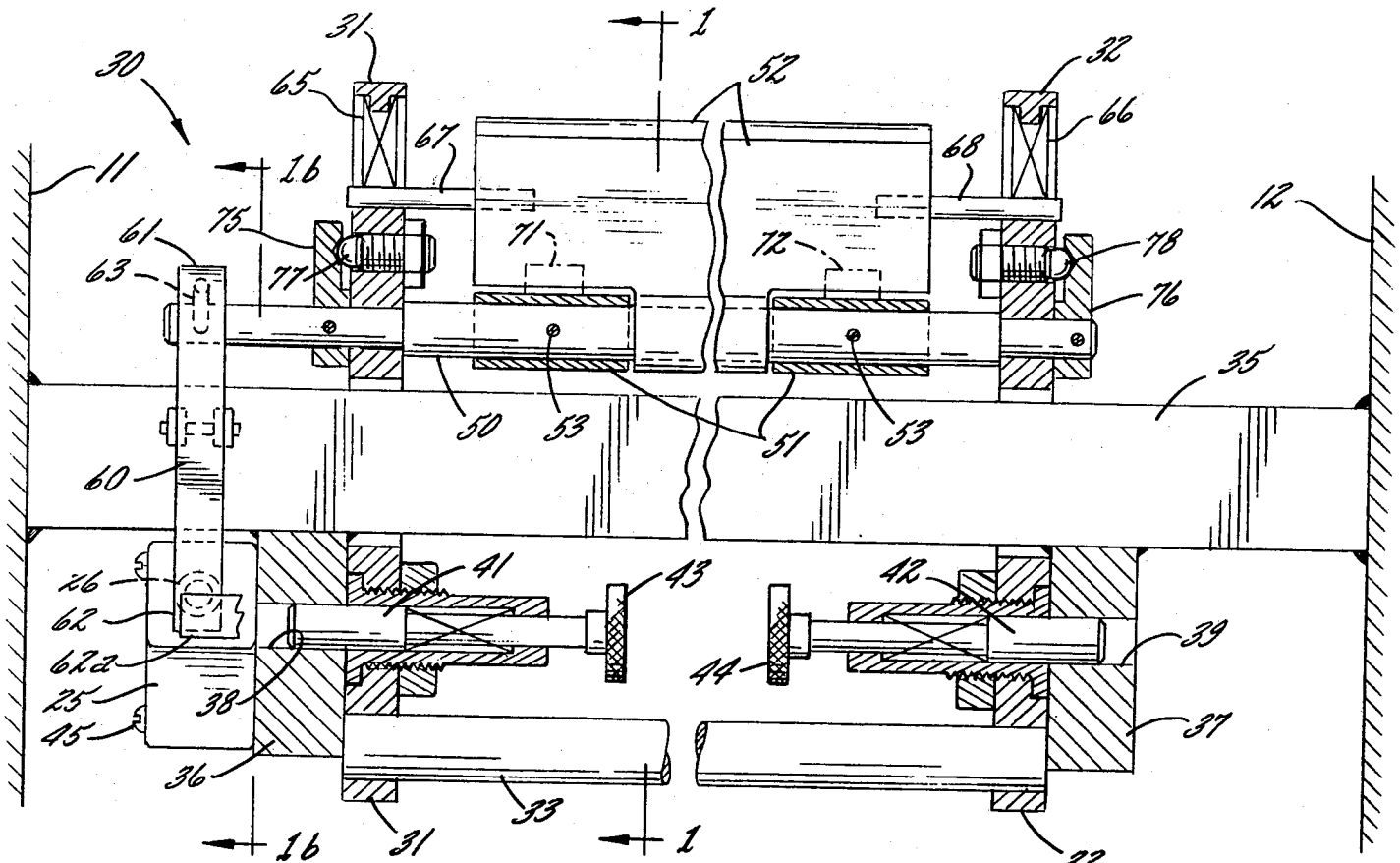
FIG. 2 is a plan view, in partial section, of the device shown in FIG. 1.

Turning now to FIGS. 1 and 2 of the drawings a portion of a rotary printing press is shown having side frames 11, 12 journalling lower and upper blanket cylinders 13, 14 in running engagement with an impression cylinder 15. The cylinders are arranged as to define between them lower and upper nips 16, 17 having a horizontally accessible recess space S. The illustrated cylinders, and their associated lower and upper plate cylinders 18, 19 (FIG. 5) are driven in unison by a drive including a motor M. In the normal, or forward, direction of the press drive the nip 16 is an inlet nip while the nip 17 is an outlet nip, these directions being reversed upon reversal of the drive.

A control circuit diagram 20 for the motor M is set forth in rudimentary form in FIG. 1*a*. Such diagram includes a reverse "inching" circuit 21 and a drive "enabling" circuit 22 under the control of a forward-reverse switch 23. A reverse "inch" push button 24 is in series with the circuit 21, while a safety interlock switch 25 is arranged in series with the drive circuit 22 for "enabling" operation in the drive mode, the switch being shown in the open, or disabling, position. The mechanism to be described has for its purpose (a) the closing of switch 25, by pressing on its plunger 26, to enable normal press operation, as long as the nips 16, 17 are protected, and (b) insuring that the switch is kept open, so that operation of the press is limited to the inching mode, as long as the nips are unprotected.

In accordance with the present invention a safety subassembly is mounted in the access space S between the side frames, the subassembly having a horizontally hinged guard plate thereon swingable between a downwardly extending normal position and a horizontally extending alternate position in which it opens up the access space for manual cleaning. A linkage couples the guard plate to the interlock switch 25 so that when the guard plate is in its normal closing position the enabling circuit is enabled for normal driving of the press and so that when the guard plate departs from the normal position the circuit is disabled with operation of the press being thereby limited to inching movement, the subassembly being bodily removable from the access space.

In the present instance the safety subassembly, generally indicated at 30, has a frame including side members 31, 32 interconnected by a cross bar 33. For mounting the subassembly a transverse frame member 35, extending between the side frames 11, 12, has a pair of axially spaced brackets 36, 37 welded thereto formed with aligned openings 38, 39. Secured to the walls of the subassembly are spring-pressed plungers 41, 42 which register with the openings 38, 39 and which are provided with knobs 43, 44, respectively, for retraction. Any desired means may be provided for securing the subassembly 30 against toppling movement when the plungers 41, 42 are in their inserted positions; for example, the side members 31, 32 may be notched out to provide a close nested fit with respect to the transverse frame member 35.

The switch 25 is stationarily secured on the outside surface of bracket 36 by any desired means, for example, by one or more screws 45.

For the purpose of closing off access to the nips a shaft 50 is provided carrying a guard plate which is formed in lower and upper sections 51, 52, the lower section 51 being pinned to the shaft by pins 53.

A linkage is interposed between the switch 25 and the lower section 51 of the guard plate so that when the plate is in guarding, or closing, position as illustrated in FIG. 1 the plunger 26 of the interlock switch 25 is depressed, permitting the press drive to operate normally. Such linkage, illustrated in FIG. 1*b*, takes the form of a centrally pivoted lever 60 having an input end 61 which is actuated by the shaft 50 and an output end 62 which extends to a position opposite the plunger 26 of the interlock switch 25. Radially extending from the end of the shaft 50 and in the path of movement of the end 61 of the lever is a camming pin 63. Thus when the lower section 51 of the guard plate is in its vertical closing position, the camming pin 63 is in the position illustrated in FIG. 1*b* to actuate the switch 25; however, when the guard plate is swung to a horizontally extending open position, illustrated in FIG. 3, the pin 63 swings clear of the lever 60 releasing the force on the switch plunger so that the switch 25 opens, thereby to disable the forward drive circuit leading to the motor M. This opens up the access space S so that access may be had to the cylinder surfaces, and to the lower nip, for inspection and manual cleaning. During the time that the interlock switch is open, operation of the press is limited to the reverse inching mode upon manual pressing of the reverse inching push button 24.

To limit the arc of swinging movement of the lever when it is released, and to shield the switch plunger against being accidently pressed, a metal shield plate 64 is arranged in a position which overhangs the end 62 of the lever.

In accordance with one of the aspects of the present invention the upper section 52 of the guard plate is freely pivoted on the shaft 50 and occupies a normal spring pressed sheet-guiding position illustrated in FIG. 1 as long as the lower section of the guard plate is in its protecting position, the two sections of the guard plate, taken together, forming an efficient sheet guide during normal running of the press. The means for holding the upper section 52 of the plate in its normal position includes a pair of coil springs 65, 66 recessed in the side members 31, 32, respectively. The springs bear upon respective aligned pins 67, 68 which are anchored, by welding or the like, to the underside of the plate 52.

Figure 3:
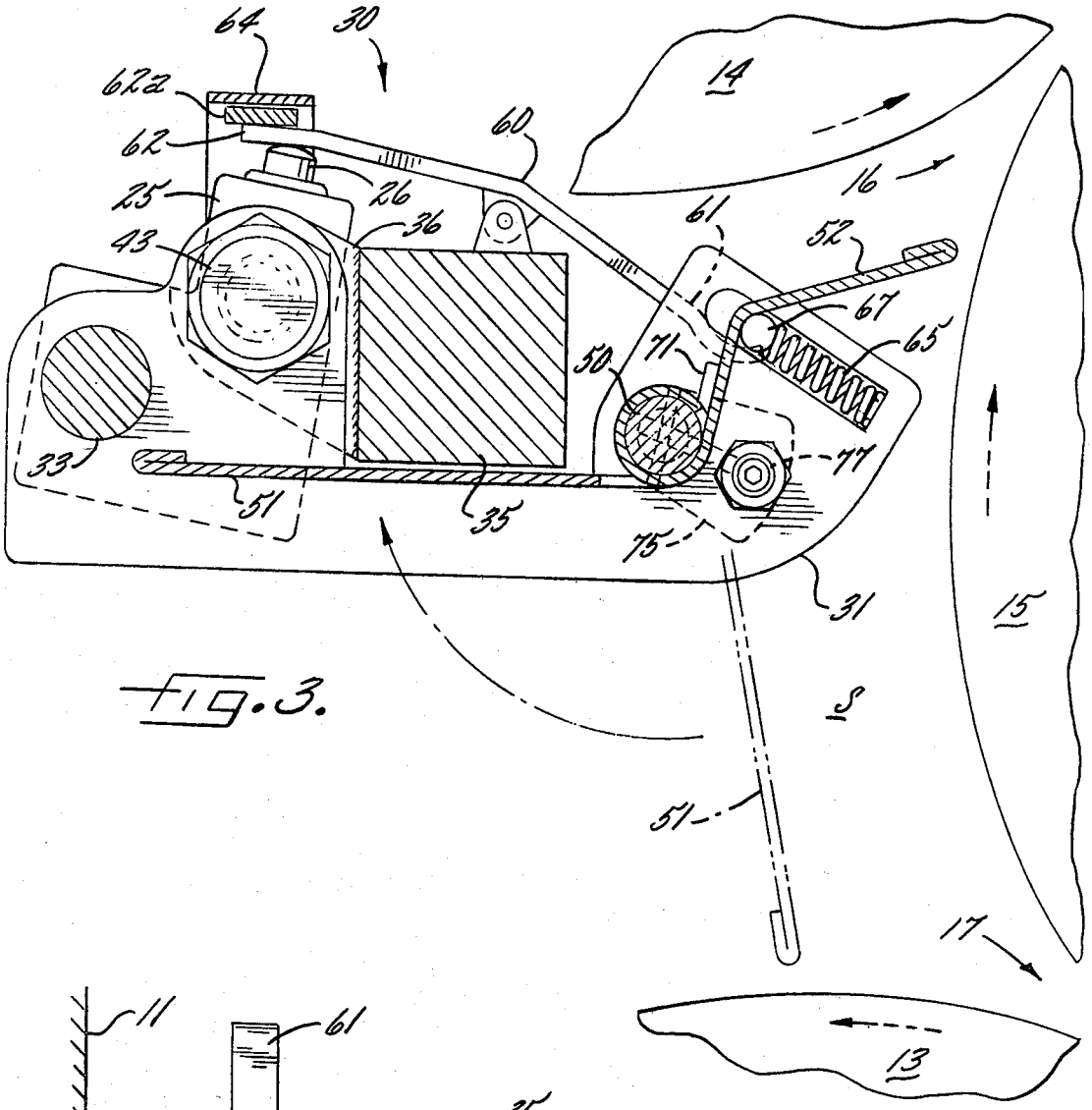
FIG. 3 is an elevational view corresponding to FIG. 1 but showing the guard plate in upwardly swung position and the switch in its disabling (released) condition.

In accordance with one of the aspects of the present invention, the lower section 51 of the guard plate is provided with a pair of stops in the form of lugs 71, 72 which, during the upward swing of the plate 51 to its open position, and particularly during the final portion of such movement, engage the plate 52 to swing the latter clockwise against the force of the springs 65, 66, from the guiding position illustrated in FIG. 1 to the position illustrated in FIG. 3. The latter has the advantage that during the reverse inching mode, to which the press is limited when the plate 51 is swung to its open position, the upper nip, which during reverse operation becomes an inlet nip, is shielded against access by the operator during manual cleaning.

In order to retain the shaft 50, and the guard plates 51, 52 thereon in their alternate positions illustrated in FIG. 3 against the restoring force of the springs 65, 66, ball detent assemblies are provided on the shaft 50 in the form of arcuate sectors 75, 76 pinned to the shaft and which are engaged by spring pressed balls 77, 78 which register with recesses, or dimples, formed in the sectors.

Because the supporting effect of the camming pin 63 at the end 61 of the lever 60 is active over a relatively narrow angle, disabling of the interlock switch 25 occurs either when the plate 51 is swung to its horizontal position illustrated in FIG. 3 or is swung in the opposite direction to position 51*a* illustrated in FIG. 1. Motion beyond the position 51*a* is, however, prevented by a stop surface 79 on the frame member 35 which is engaged by sector 75 (FIG. 1).

Figure 4:
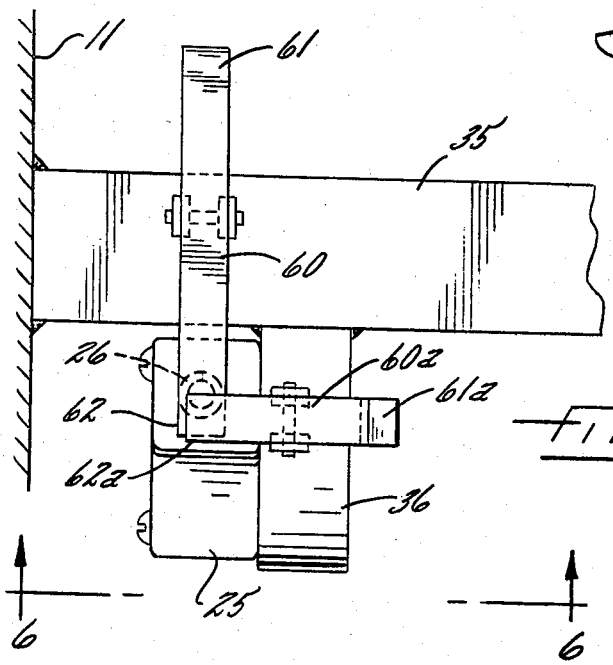
FIG. 4 is a fragmentary plan view of the mounting means on the press with the safety assembly removed.

In accordance with one of the important aspects of the present invention, the interlock switch 25 is stationarily mounted on the press so that it is not only released, for disabling purposes, upon swinging of the guard plate 51 upwardly into open position but is released when the safety subassembly 30 is bodily removed from the press. The safety subassembly may be readily disengaged, as previously noted, by manipulation of the knobs 43, 44 which retracts the plungers 41, 42 from the openings in the supporting brackets 36, 37. Not only is the switch 25 a stationary part of the press, but the centrally pivoted link, or lever, 60 is permanently pivoted on the press member 35 and thus remains behind when the subassembly 30 is removed, as illustrated in FIG. 4.

In accordance with a further aspect of the present invention, a washing subassembly is provided for mounting in position in the access space S in place of the safety subassembly and which, in addition to performing its washing function, serves to block access to the cylinder nips, with a disengageable linkage being provided for coupling the washing subassembly to the interlock switch 25 so that the switch is actuated to energize the drive enabling circuit to permit normal driving of the press for washing purposes.

In the discussion of the washing subassembly which follows, elements of such subassembly which correspond to elements of the safety subassembly will be denoted with the same reference numeral with addition of subscript a, thereby to bring out the similarity of function.

Figure 5:
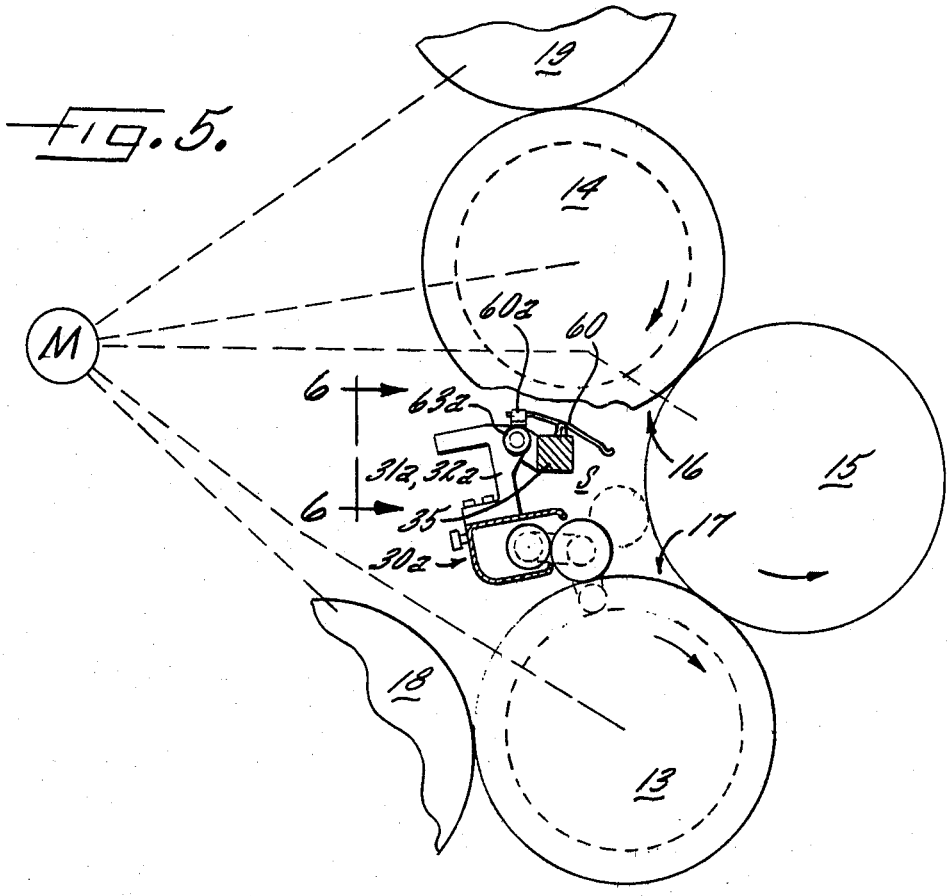
FIG. 5 is an elevational showing substitution of a washing subassembly in place of the safety device as viewed along line 5—5 in FIG. 6.
Figure 6:
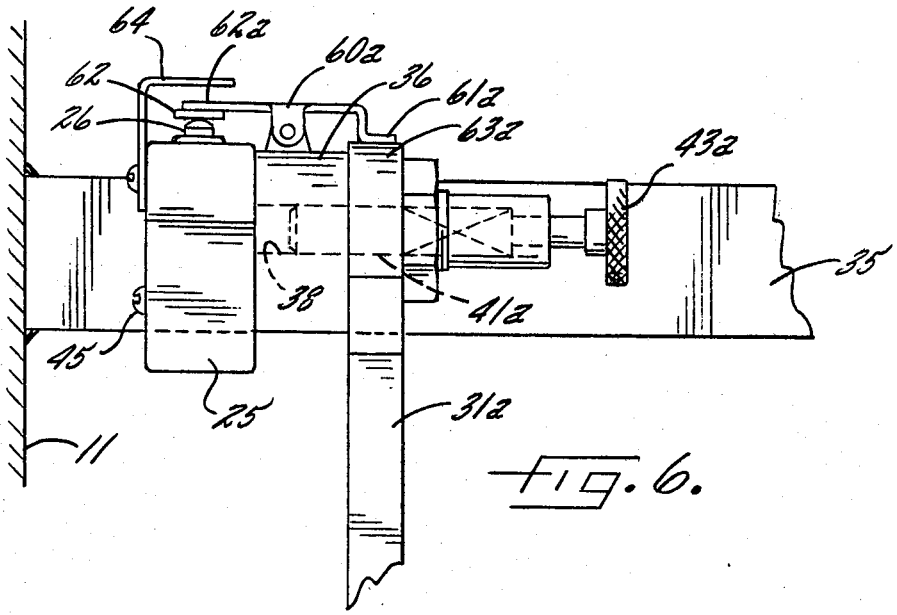
FIG. 6 is a fragmentary elevation showing the profile of the lever included in the linkage which couples the washing subassembly to the interlock switch as viewed along line 6—6 in FIG. 4 and FIG. 5.

Turning to FIGS. 5 and 6, the washing subassembly, indicated at 30*a*, is supported on arms 31*a*, 32*a*. For the details of construction of the washing assembly cross reference is made to Difflipp et al. application, Ser. No. 073,661 which was filed Sept. 10, 1979. It will suffice to say that the washing subassembly includes a washing roller and source of liquid and is bodily swingable between a first position illustrated in FIG. 5, in which the washing roller engages the surface of the blanket cylinder 13, and an alternate position in which the washing roller, indicated in dot-dash, engages the surface of the impression cylinder 15. It will be noted in FIG. 5 that in both positions the nips 16, 17 are fully protected. Each of the arms 31*a*, 32*a*, forming a part of the washing subassembly is provided with a spring-pressed plunger for engaging the openings in the brackets 36, 37. Thus the plunger 41*a*, retractable by a knob 43*a*, registers with the opening 38 (FIG. 6).

For the purpose of coupling the washing subassembly to the plunger 26 of the interlock switch 25, linkage is provided in the form of a centrally pivoted lever 60*a* having an input end 61*a* and an output end 62*a*. The lever 60*a* is oriented at approximate right angles to the lever 60 as shown in FIG. 4, with the end 62*a* being in a superimposed position so that either of the levers 60, 60*a* is capable of applying pressure to the interlock switch for enabling the drive circuit.

In order to maintain the plunger of the interlock switch 25 depressed in all of the positions of the washing unit throughout its range of swinging movement, the input end 61*a* of the lever engages a cylindrical surface 63*a* formed on the arm 31*a*. The lever 60*a*, as in the case of the lever 60, is stationarily secured to the press, in the present instance by being pivotally captive on the bracket 36. Thus upon retraction of the knob 43*a* on the plunger 41*a*, accompanied by similar retraction at the other end of the assembly, the washing unit may be readily disengaged, breaking contact between the end 61*a* of the lever and the surface 63*a* which it engages, releasing the interlock switch 25 and restoring it to its disabling condition.

It will be apparent that the objects of the invention have been amply met. The safety subassembly 30 is easily and quickly installed by lifting it into position while retracting the knobs associated with the plungers 41, 42, with such plungers clicking into engaged position and causing the end 61 of the lever 60 to be aligned in the path of movement of the camming pin 63. Swinging the guard plate from the position illustrated in FIG. 3 to the closing position of FIG. 1 accomplishes two effects: It releases the upper section 52 of the guard plate permitting the springs 65, 66 to expand so that the guard plate, as a whole, assumes a sheet guiding position. Secondly, the camming pin 63 is swung into engagement with the lever 60 rocking such lever counterclockwise, as viewed in FIGS. 1 and 1*b*, so that the switch 25 is in its enabling, closed state. Thus when the switch 23 (FIG. 1*a*), or similar switch in a practical circuit, is moved to the "drive" position the press is driven forwardly at normal speed.

When the lower section of the plate is swung manually to the upraised position to permit access for purposes of inspection or cleaning, the interlock switch 25 is released to its disabling state so that operation of the press is limited to reverse inching movement under the control of the push button 24. Such movement presents no hazard since the exposed lower nip is now an outlet and since the upper nip is now fully shielded by means of the upper section 52 of the guard plate.

When periodic washing of the cylinders is required, the safety subassembly is simply dropped out of position by retraction of the knobs 43, 44, disengaging the camming pin 63 from its lever 60, and disabling normal driving, followed immediately by substitution of the washing unit 30*a* which, through the action of the lever 60*a*, acting upon switch 25 restores the driving function, thereby permitting normal driving of the press for washing purposes.

While the invention has been described in connection with substitution of a washing subassembly in the access space to provide a protective function in the absence of the safety subassembly, it will be understood that the invention is not limited thereto and contemplates substitution of any auxiliary unit of appropriate size in place of the safety subassembly; thus the term "washing subassembly" shall be interpreted to include any substitute device occupying substantially the entire access space and which is therefore similarly effective in performing an incidental guarding function.

While it is one of the features of the described construction that a unitary, stationarily mounted interlock switch 25 cooperates in succession with both the safety subassembly and the washing subassembly, it will be understood that the invention is not limited to use with a unitary switch and that the switch 25 may be provided in two sections for respective cooperation with levers 60, 60*a*, or equivalent linkages, the two sections in such event having contacts which are electrically connected in parallel with one another.

What we claim is:

1. In a sheet-fed rotary printing press the combination comprising a pair of side frames, lower and upper blanket cylinders in running engagement with an impression cylinder, the cylinders being so arranged as to define between them lower and upper nips having a horizontally accessible access space, driving means for the cylinders including an inching circuit and a drive enabling circuit, an interlock switch stationarily mounted adjacent the access space and connected in the drive enabling circuit, a safety subassembly mounted in the access space between the side frames, the subassembly having a horizontal shaft, a guard plate thereon, the guard plate being swingable between (a) a downwardly extending normal position in which the plate closes off the access space and serves as a sheet guide and (b) a horizontally extending alternate position in which it opens up the access space for manual cleaning, and a linkage coupling the guard plate to the interlock switch so arranged that when the guard plate is in its normal closing position the enabling circuit is enabled for normal driving of the press and so that when the guard plate departs from its normal position such circuit is disabled with operation of the press being thereby limiting to inching movement, the subassembly being bodily removable from the access space.

2. In a sheet-fed rotary printing press the combination comprising a pair of side frames, lower and upper blanket cylinders in running engagement with an impression cylinder, the cylinders being so arranged as to define between them lower and upper nips having a horizontally accessible access space, driving means for the cylinders including an inching circuit and a drive enabling circuit, an interlock switch stationarily mounted adjacent the access space and connected in the drive enabling circuit, a safety subassembly, quickly disengageable mounting means for mounting the subassembly in the access space adjacent the interlock switch, the subassembly having a guard plate thereon, the guard plate having a downwardly extending normal position in which the plate closes off the access space and serves as a sheet guide, and a disengageable linkage coupling the guard plate to the interlock switch so arranged that when the guard plate is in its normal closed position the enabling circuit is enabled for normal driving of the press and so that when the subassembly is disengaged from its mounting means such circuit is disabled with operation of the press being thereby limited to inching movement.

3. In a sheet-fed rotary printing press the combination comprising a pair of side frames, lower and upper blanket cylinders in running engagement with an impression cylinder, the cylinders being so arranged as to define between them a normally-inlet lower nip and a normally-outlet upper nip having a horizontally accessible access space, driving means for the cylinders including a reverse inching circuit and a drive enabling circuit, an interlock switch stationarily mounted adjacent the access space and connected in the drive enabling circuit, a safety subassembly mounted in the access space between the side frames, a guard plate in the subassembly having lower and upper sections and having (a) a normal closing position in which the lower section closes off the access space and serves as a sheet guide and (b) an alternate open position in which the lower section opens up the access space for manual closing, and a linkage coupling the guard plate to the interlock switch so arranged that when the guard plate is in its normal closing position the enabling circuit is enabled for normal operation of the press and so that when the lower section of the guard plate is in its alternate open position such circuit is disabled with operation of the press being thereby limited to reverse inching movement.

4. In a sheet-fed rotary printing press the combination comprising a pair of side frames, lower and upper blanket cylinders in running engagement with an impression cylinder, the cylinders being so arranged as to define between them a normally-inlet lower nip and a normally-outlet upper nip having a horizontally accessible access space, driving means for the cylinders including a reverse inching circuit and a drive enabling circuit, an interlock switch stationarily mounted adjacent the access space and connected in the drive enabling circuit, a safety subassembly mounted in the access space between the side frames, a guard plate in the subassembly having movable lower and upper sections, the sections being relatively hinged together, the lower section having (a) a normal closing position in which it closes off the access space and serves, with the upper section, as a sheet guide and (b) an alternate open position in which it opens up the access space for manual cleaning, and a linkage coupling the lower portion guard plate to the interlock switch so arranged that when the lower section of the guard plate is in its normal closing position the enabling circuit is enabled for normal driving of the press and so that when the lower section of the guard plate is in its alternate open position such circuit is disabled with the operation of the press being thereby limited to reverse inching movement, means for positioning the upper section of the guard plate in a normal position, and means for mechanically coupling the sections so that they move in unison to respective alternate positions.

5. The combination as claimed in claim 3 or in claim 4 in which the upper section of the guard plate has a spring for biasing the same into a normal sheet-guiding position, the sections of the guard plate having stops which are interengaged as the lower section of the plate moves from its closing position to its open position for moving the upper section against the force of bias from its normal sheet-guiding position to an alternate position in which the upper section blocks the upper nip to shield the operator therefrom when the press is in its reverse inching mode.

6. In a sheet-fed rotary printing press the combination comprising a pair of side frames, lower and upper blanket cylinders in running engagement with an impression cylinder, the cylinders being so arranged as to define between them lower and upper nips having a horizontally accessible access space, driving means for the cylinders including an inching circuit and a drive enabling circuit, an interlock switch stationarily mounted adjacent the access space and connected in the drive enabling circuit, a safety subassembly, a washing subassembly, quickly disengageable means for mounting the said subassemblies in position successively in the access space, the safety subassembly including a guard plate having a normal closing position in which the plate closes off the access space and serves as a sheet guide, a first disengageable linkage coupling the guard plate to the interlock switch and so arranged that when the safety subassembly is mounted in the access space with the guard plate thereon in its normal closing position the enabling circuit is enabled for normal driving of the press and so that when the guard plate is absent from its normal position the enabling circuit is disabled with operation of the press being thereby limited to inching movement, and a second disengageable linkage coupling the washing subassembly to the interlock switch and so arranged that when the washing subassembly is mounted in position in the access space in place of the safety subassembly the enabling circuit is enabled permitting normal driving of the press for washing purposes.

7. In a sheet-fed rotary printing press the combination comprising a pair of side frames, lower and upper blanket cylinders in running engagement with an impression cylinder, the cylinders being so arranged as to define between them lower and upper nips having a horizontally accessible access space, driving means for the cylinders including an inching circuit and a drive enabling circuit, an interlock switch stationarily mounted adjacent the access space and connected in the drive enabling circuit, a safety subassembly and a washing subassembly, quickly disengageable means for mounting the subassemblies in position successively in the access space, the safety subassembly having a guard plate pivotally mounted for movement between a downwardly extending closing position in which the plate closes off the access space and serves as a sheet guide and an upwardly swung open position in which it opens up the access space for manual cleaning, a disengageable safety linkage for coupling the guard plate to the interlock switch so arranged that when the guard plate is in its closing position the enabling circuit is enabled and so that when the guard plate is in its upwardly swung position such circuit is disabled with operation of the press being thereby limited to inching movement, and a disengageable wash linkage coupling the washing subassembly to the interlock switch so arranged that when the washing subassembly is mounted in position in the access space in place of the safety subassembly the enabling circuit is enabled permitting normal driving of the press for washing purposes.

8. The combination as claimed in claim 1 or in claim 7 in which the guard plate has stops for establishing the limits of swinging movement.

9. The combination as claimed in claim 1 or in claim 7 in which the guard plate has a detent for holding the guard plate in alternate positions.

10. The combination as claimed in claim 6 or in claim 7 in which the enabling switch has an actuator and in which the linkages include respective centrally pivoted levers each having an input end and an output end with the output ends being so arranged that they are independently able to operate the actuator to place the switch in its enabling condition.

11. In a sheet-fed rotary printing press the combination comprising a pair of side frames, lower and upper blanket cylinders in running engagement with an impression cylinder, the cylinders being so arranged as to define between them lower and upper nips having a horizontally accessible access space, driving means for the cylinders including an inching circuit and a drive enabling circuit, an interlock switch stationarily mounted adjacent the access space and connected in the drive enabling circuit, a safety subassembly, a washing subassembly, quickly disengageable means for mounting the said subassemblies in position successively in the access space, the mounting means being in the form of a quickly disengageable horizontal hinge connection permitting vertical swinging of the washing assembly between alternate positions, the safety subassembly including a guard plate having a normal closing position in which the plate closes off the access space and serves as a sheet guide, a first disengageable linkage coupling the guard plate to the interlock switch and so arranged that when the safety subassembly is mounted in the access space with the guard plate thereon in its normal closing position the enabling circuit is enabled for normal driving of the press and so that when the guard plate is absent from its normal position the enabling circuit is disabled with operation of the press being thereby limited to inching movement, and a second disengageable linkage coupling the washing subassembly to the interlock switch and effective in the alternate positions of the working subassembly so arranged that when the washing subassembly is mounted in position in the access space in place of the safety subassembly the enabling circuit is enabled permitting normal driving of the press for washing purposes.

12. In a sheet-fed rotary printing press the combination comprising a pair of side frames, a blanket cylinder in running engagement with an impression cylinder defining between them a nip having a horizontally accessible access space, driving means for the cylinders including an inching circuit and a drive enabling circuit, an interlock switch stationarily mounted adjacent the access space and connected to the drive enabling circuit, a safety subassembly in the access space between the side frames, the subassembly having a horizontal shaft, a guard plate thereon, the guard plate having a vertically extending normal position in which the plate closes off the access space and an alternate position in which it opens up the access space for manual cleaning, and a linkage coupling the guard plate to the interlock switch so arranged that when the guard plate is in its normal position the enabling circuit is enabled for normal driving of the press and so that when the guard plate is in its alternate position such circuit is disabled with operation of the press being thereby limited to inching movement.

13. In a sheet-fed rotary printing press the combination comprising a pair of side frames, a blanket cylinder in running engagement with an impression cylinder defining between them a nip having a horizontally accessible access space, driving means for the cylinders including an inching circuit and a drive enabling circuit, an interlock switch stationarily mounted adjacent the access spaced and connected in the drive enabling circuit, a safety subassembly, quickly disengageable mounting means for mounting the subassembly in the access space adjacent the interlock switch, the subassembly including a guard plate having a vertically extending normal position in which the plate closes off the access space and serves as a sheet guide, and a disengageable linkage coupling the guard plate to the interlock switch so arranged that when the guard plate is in its normal closed position the enabling circuit is enabled for normal driving of the press and so that when the subassembly is disengaged from its mounting means such circuit is disabled with operation of the press being thereby limited to inching movement.

14. In a sheet-fed rotary printing press the combination comprising a pair of side frames, a blanket cylinder in running engagement with an impression cylinder defining between them a nip having a horizontally accessible access space, driving means for the cylinders including an inching circuit and a drive enabling circuit, an interlock switch stationarily mounted adjacent the access space and connected in the drive enabling circuit, a safety subassembly, a washing subassembly, quickly disengageable means for mounting the said subassemblies in position successively in the access space, the safety subassembly including a guard plate having a normal closing position in which the plate closes off the access space, a first disengageable linkage coupling the guard plate to the interlock switch and so arranged that when the safety subassembly is mounted in the access space with the guard plate thereon in its normal closing position the enabling circuit is enabled for normal driving of the press and so that when the guard plate is absent from its normal position the enabling circuit is disabled with operation of the press being thereby limited to inching movement, and a second disengageable linkage coupling the washing subassembly to the interlock switch and so arranged that when the washing subassembly is mounted in position in the access space in place of the safety subassembly the enabling circuit is enabled permitting normal driving of the press for washing purposes.

* * * * *